US005833123A

United States Patent [19]

Gueret

[11] Patent Number: 5,833,123

[45] Date of Patent: Nov. 10, 1998

[54] PACKAGING AND DISPENSING DEVICE

[75] Inventor: Jean-Louis Gueret, Paris, France

[73] Assignee: L'Oreal, Paris, France

[21] Appl. No.: 716,647

[22] Filed: Sep. 16, 1996

[30] Foreign Application Priority Data

Sep. 25, 1995 [FR] France ..... 95 11203

[51] Int. Cl.[6] ..... B67D 5/32

[52] U.S. Cl. ..... 222/153.06; 222/482; 222/494; 222/553

[58] Field of Search ..... 222/153.06, 212, 222/481.5, 482, 494, 541.6, 548, 553

[56] References Cited

U.S. PATENT DOCUMENTS

| | | | |
|---|---|---|---|
| 5,161,718 | 11/1992 | Gueret | 222/553 |
| 5,267,673 | 12/1993 | Crosnier et al. | 222/494 |
| 5,310,111 | 5/1994 | Meshberg | 222/482 |
| 5,617,978 | 4/1997 | Geier | 222/494 |
| 5,655,685 | 8/1997 | Carr et al. | 222/153.06 |
| 5,662,245 | 9/1997 | Grant | 222/556 |

FOREIGN PATENT DOCUMENTS

| | | |
|---|---|---|
| A1-0 452 196 | 10/1991 | European Pat. Off. . |
| A1-0 622 124 | 11/1994 | European Pat. Off. . |
| A3-0 649 795 | 4/1995 | European Pat. Off. . |
| A-2 650 562 | 2/1991 | France . |

*Primary Examiner*—Joseph Kaufman
*Attorney, Agent, or Firm*—Oliff & Berridge, PLC

[57] ABSTRACT

A device for packaging and dispensing a substance in liquid, gel, or paste form, the device being of the type comprising a receptacle for containing said substance and a dispensing head provided with an orifice for dispensing the substance and with a shutter that is suitable for closing said orifice when the substance is not being dispensed, and suitable for opening under the effect of pressure in the substance upstream, wherein the dispensing head includes at least two portions which are made as a single piece by being molded with a third portion and each of which is connected thereto by a respective hinge-forming bridge of material, one of the two portions connected to the third portion also carrying said shutter.

14 Claims, 5 Drawing Sheets

PACKAGING AND DISPENSING DEVICE

FIELD OF THE INVENTION

The present invention relates to a device for packaging and dispensing a substance in liquid, gel, or paste form, the device being of the type comprising a receptacle for containing said substance and a dispensing head provided with an orifice for dispensing the substance and with a shutter that is suitable for closing said orifice when the substance is not being dispensed, and suitable for opening while dispensing is taking place under the effect of pressure in the substance upstream.

Such a device is known from EP-A-0 452 196 in the name of the Applicant company.

OBJECTS AND SUMMARY OF THE INVENTION

The invention seeks to further improve such a device.

It achieves this by the fact that the dispensing head includes at least two portions which are made as a single piece by being molded with a third portion and each of which is connected thereto by a respective hinge-forming bridge of material, one of the two portions connected to the third portion also carrying said shutter.

In a particular embodiment of the invention, the dispensing head includes an endpiece to be fixed in an opening of the receptacle or on a pump or on a valve with which the receptacle is fitted, and said portions, each connected to the third portion via a respective hinge-forming bridge of material, constitute a moving capsule fitted with said dispensing orifice and mounted with the ability to move relative to the endpiece between an open position in which communication is established between the dispensing orifice and the inside of the receptacle, and a closed position in which the capsule co-operates with the endpiece to isolate said dispensing orifice from the inside of the receptacle.

Advantageously, the endpiece is integrally formed by being molded with said third portion, being connected thereto by breakable bridges of material. In an embodiment of the invention, the breakable bridges of material are for breaking on first use of the device and they constitute proof that the device has not been tampered with. In a variant, the bridges of breakable material may be broken when the capsule is mounted on the receptacle.

In a particular embodiment of the invention, said shutter is made by molding an elastomer material over one of said portions.

In another embodiment, the shutter is integrally molded with one of the portions.

In a particular embodiment of the invention, the capsule is made by molding a portion forming an annular body connected to the endpiece via at least one bridge of material, and by two pivoting portions each connected to said annular body via a respective hinge-forming bridge of material, the above-mentioned shutter being secured to one of said portions, one of the two pivoting portions constituting a closure flap shaped to be suitable for co-operating with the other pivoting portion to retain it on said annular body after pivoting.

In a particular embodiment of the invention, the shutter is secured to the pivoting portion forming the closure flap.

In another particular embodiment of the invention, the shutter is secured to the portion which is retained on said third portion by the closure flap.

In a particular embodiment of the invention, the portion of the dispensing head which carries the shutter that opens to dispense the substance further includes a shutter for admitting air.

Advantageously, the shutter that opens to dispense the substance and the shutter for admitting air are made as a single piece by overmolding elastomer material.

In the above-mentioned particular embodiment where the shutter is integrally molded with the portion that carries it, the shutter is preferably Ω-shaped and its free edge leaves a gap lying preferably in the range 0.1 mm to 0.2 mm relative to the facing edge.

BRIEF DESCRIPTION OF THE DRAWINGS

Other characteristics and advantages of the present invention appear on reading the following detailed description of non-limiting embodiments of the invention and on examining the accompanying drawings, in which.

MORE DETAILED DESCRIPTION

Figure 1:
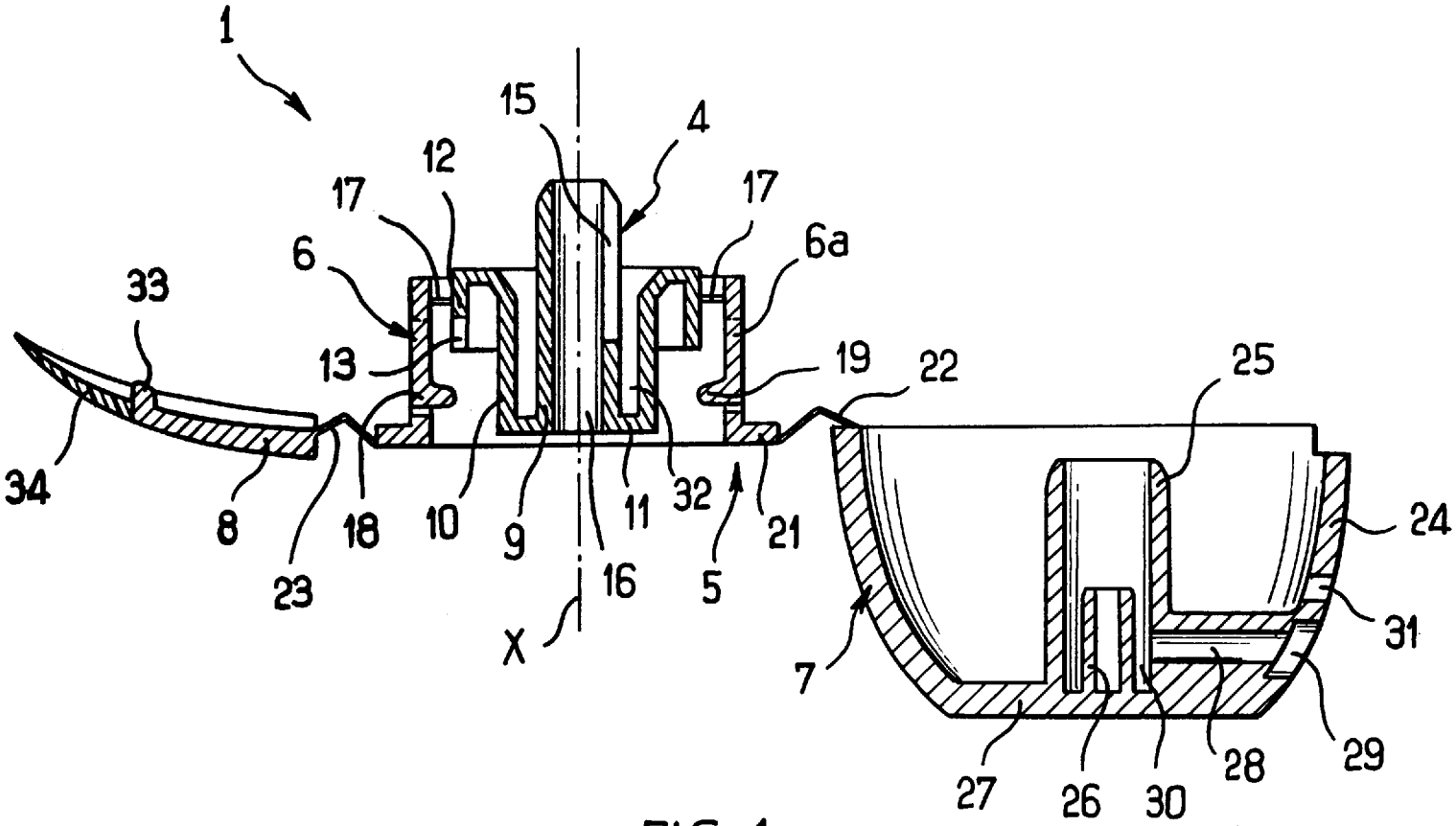
FIG. 1 is a diagrammatic axial section view of an assembly forming a dispensing head and constituted by an endpiece and a capsule that are made as a single piece by molding a plastics material.
Figure 2:
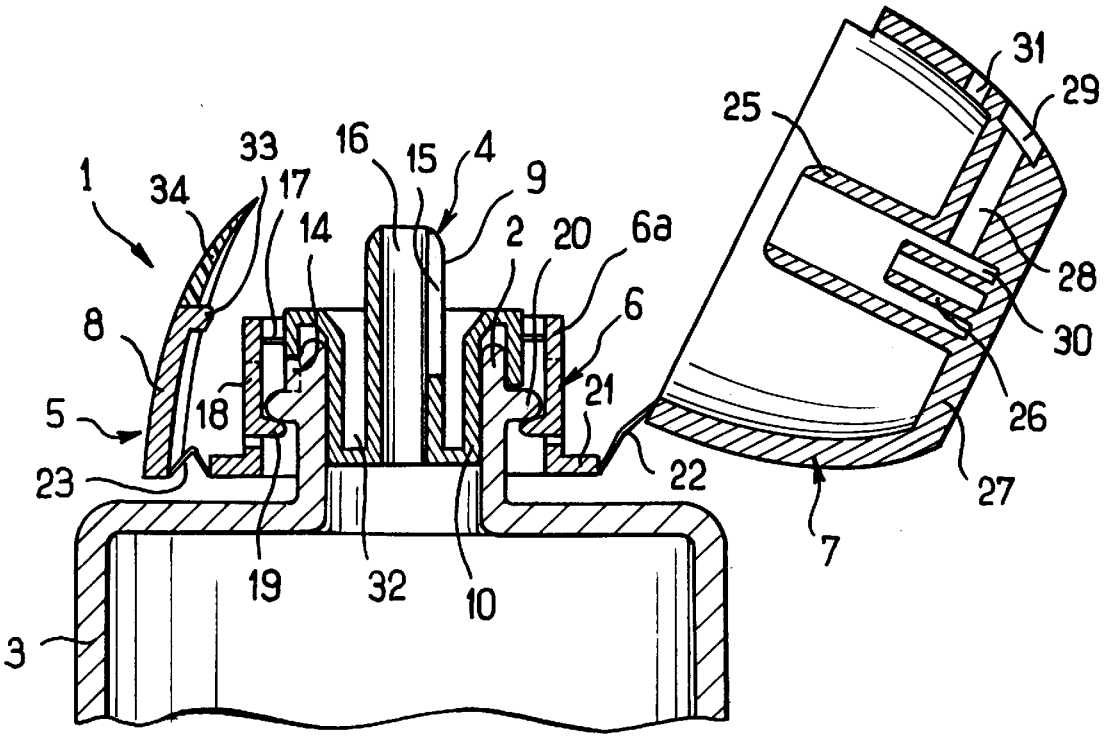
FIGS. 2 and 3 show various steps in assembling the dispensing head shown in FIG. 1 on the neck of a receptacle.
Figure 3:
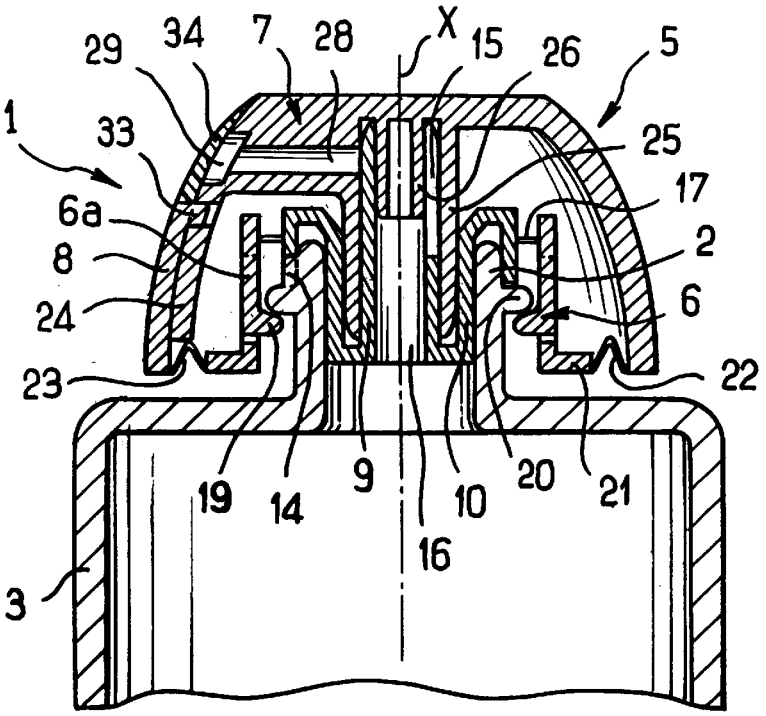

FIGS. 1 to 3 show a dispensing head 1 constituting a first embodiment of the invention and designed to be mounted on the neck 2 of a conventional receptacle 3, e.g. made by an injection-blow molding technique. The dispensing head 1 comprises an endpiece 4 to be fixed in the neck 2 and a capsule 5 integrally formed with the endpiece 4 and comprising in combination an annular body 6, a pivoting cover 7, and a pivoting flap 8.

The endpiece 4 has two tubular skirts 9 and 10 that are coaxial about the axis X, that are of circular cross-section, and that are connected together at their bottom ends 11. The radially outer tubular skirt, referenced 10, is extended radially outwards at its top end to form an annular rim 12 that curves downwards and that is shaped to engage on the top end edge of the neck 2. As shown in FIG. 1, the radially inner tubular skirt 9 extends axially at its top end above the annular rim 12. The annular rim 12 has a gap over a limited angular sector of its periphery to form a cutout 13 that is designed to co-operate with a spline 14 of complementary shape projecting from the radially outer surface of the neck 2 to prevent the endpiece 4 from rotating on the neck 2. The tubular skirt 9 has a slot running from its top end edge and occupying a limited angular sector of its periphery to form a lateral opening 15 through which substance passes as described below.

The outside diameter of the tubular skirt 10 is selected so that the endpiece 4 is a leakproof force-fit in the neck 2.

Internally, the tubular skirt 9 defines a channel 16 along which substance passes from the inside of the receptacle 3. Once it is in place in the neck 2, the endpiece 4 reduces the through section offered to flow of substance leaving the receptacle 3 via the neck 2.

As shown in FIGS. 2 and 3, the annular body 6 has a generally tubular wall 6*a* of circular cross-section centered on the axis X, on which there are formed at least two diametrically opposite flexible retaining tongues 18 provided at their bottom ends with projections 19 extending radially from the inside surface of the wall 6*a* for the purpose of snap-fastening against an annular collar 20 projecting radially from the outside surface of the neck 2. The bottom end of the wall 6*a* is provided with a flange 21 projecting radially from its outer surface. The pivoting cover 7 and the pivoting flap 8 are connected to the flange 21 at diametrically opposite locations via respective hinge-forming bridges of material referenced 22 and 23.

Bridges of material 17 connect the radially outer surface of the annular rim 12 of the endpiece 4 to the radially inner surface of the annular body 6 in the vicinity of its top end edge.

The pivoting cover 7 has an outer shell 24 that is generally in the form of a dome with a flat top 27, and internally it has two coaxial tubes 25 and 26 connected to the inside face of the flat top 27 of the shell 24. A substance-passing channel is formed in the thickness of the top wall 27, opening out at one end into the annular space 30 formed between the tubes 25 and 26, and at its other end via a dispensing orifice 29 situated in the side wall of the shell 24. The side wall has an opening 31 substantially vertically beneath the dispensing orifice 29 for securing the pivoting flap 8 to the pivoting cover 7. The inside diameter of the tube 25 and the thickness of its wall are selected in such a manner that when the pivoting cover 7 is folded down onto the annular body 6 the tube 25 engages in the annular groove 32 formed between the tubular skirts 9 and 10 and fits in leakproof manner against the radially inner surface of the tubular skirt 10. More generally, taking account of the shape of the bridge of material 22, the tube 25 and the tubular skirt 9 are shaped in such a manner as to enable one to be mounted on the other. The outside diameter of the tube 26 is selected in such a manner that it is received inside the tubular skirt 9 when the pivoting cover 7 is in position on the annular body 6. The bridge of material 25 is made to have a V-shape, and its length is selected so as to impart sufficient mobility to the pivoting cover 7 to enable the tube 25 to be engaged on the tubular skirt 9.

The pivoting flap 8 is shaped so as to fix to the lateral outside surface of the pivoting cover 7 and it has a stud 33 suitable for engaging in the opening 31 to retain the pivoting flap 8 pressed against the pivoting cover 7. A tapering resilient blade is molded over the rigid wall constituting the remainder of the pivoting flap 8 to form a shutter 34 which, at rest, covers the dispensing orifice 29.

The stud 13 is made of rigid plastics material. In a variant it may be made of flexible plastics material, in which case it is advantageously overmolded together with the shutter (in a variant, not shown).

According to an advantageous characteristic of the invention, the endpiece 4 and the capsule 5 are made as a single piece of plastics material, thus simplifying handling of the dispensing head 1 and also simplifying installation thereof on the receptacle 3. After the endpiece 4 and the capsule 5 have been molded in the configuration shown in FIG. 1, i.e. with the pivoting flap 8 extending substantially perpendicularly to the axis X and with the tubes 25 and 26 extending substantially parallel to the axis X, the annular body 6 is snapped onto the neck 2 of the receptacle (after it has been filled), and then the cover 7 and the flap 8 are pivoted towards the annular body 6 respectively through about 180° and through about 90°, and they are assembled together by forcing the stud 33 into the opening 31. The endpiece 4 is prevented from rotating relative to the neck 2 by co-operation between the complementary shapes of the spline 14 and the cutout 13.

As shown in FIG. 3, after the capsule 5 has been assembled, the channel 28 is situated diametrically opposite the lateral slot 15 and is isolated therefrom by the tubular skirt 9.

The dispensing head 1 is thus closed, the shutter 34 isolates the substance, and any escape of the substance is prevented.

On first use of the device, the user must rotate the capsule 5 about the axis X so as to bring the lateral slot 15 into register with the channel 28.

During this rotation, the bridges of material 17 break, thereby informing the user that the device has not been used previously.

The substance can be caused to escape by squeezing the receptacle 3 if it is made of a flexible plastics material, or by any other technique for applying pressure to the substance inside the receptacle. The shutter 34 lifts off its seat against the pivoting cover 7 under drive due to the pressure of the substance upstream in the dispensing orifice 29.

After a quantity of substance has been dispensed, the shutter 34 returns to its rest position in which it closes the dispensing orifice 29 by means of its own resilience, with return of the shutter to its rest position being facilitated, where appropriate, by the suction effect that accompanies return of the receptacle 3 to its initial shape.

It should be observed that the initial dimensions of the overmolded shutter may be such as to leave a gap between the shutter and its seat against the cover 7 so as to accommodate swelling of the shutter material on coming into contact with the substance in use.

FIGS. 4 to 7 show two variant embodiments of a device of the invention to illustrate the facility provided by the invention for making a dispensing head with an undercut shape.

In the description below, identical reference numerals, merely accompanied by a prime symbol ', are used to designate elements that are identical or functionally analogous to those of the previous embodiment, thus making it possible to omit describing them again in detail.

Figure 5:
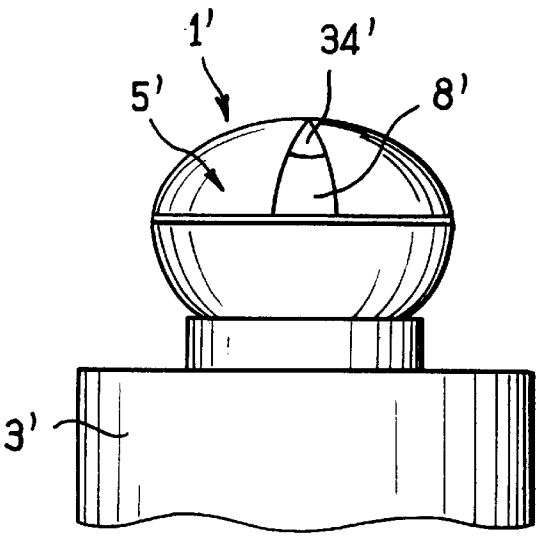
FIG. 5 is a fragmentary elevation view of a receptacle fitted with the dispensing head shown in FIG. 4.
Figure 4:
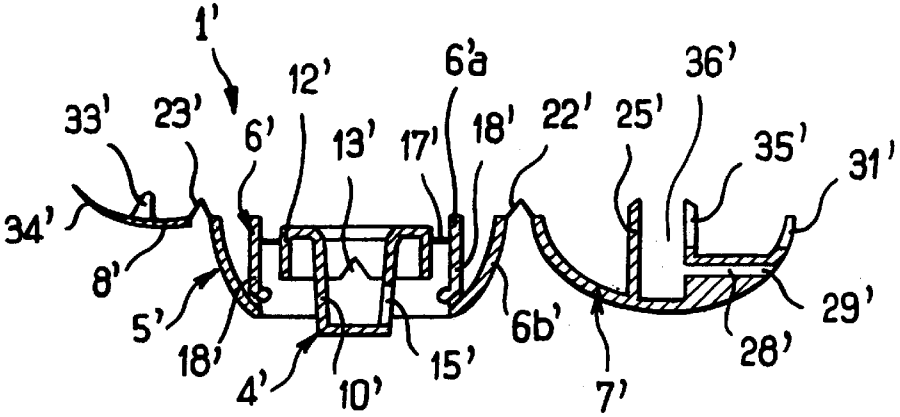
FIG. 4 is a diagrammatic axial section view of a dispensing head constituting a second embodiment of the invention.

The dispensing head 1' shown in FIGS. 4 and 5 differs from the dispensing head 1 described above essentially in the shape of its annular body 6' and the way in which the endpiece 4' and the pivoting cover 7' co-operate to isolate the channel 28' from the inside of the receptacle 3', or to put it into communication therewith. The annular body 6' has a tubular wall 6*a*' to which the bridges of material 17' are attached for connecting the endpiece 4' to the capsule 5'.

The wall 6*a*' is extended radially outwards and upwards from its bottom end by a wall 6*b*' that is generally flared in shape and convex on the outside.

The pivoting cover 7' and the pivoting flap 8' are connected to the annular body 6' by respective hinge-forming bridges of material 22' and 23' connected to the top end edge of the wall 6*b*' at diametrically opposite locations. The wall 6*b*' co-operates with the pivoting cover 7', when the cover is folded down onto the annular body 6' to form a ball-shaped dispensing head as shown in FIG. 5.

The endpiece 4' differs from the above-described endpiece 4 in that it has no tubular skirt 9, and by the fact that the tubular skirt 10' has a hole passing laterally therethrough to form an opening 15' through which substance passes from the inside of the receptacle 3' towards the dispensing channel 28'.

Naturally, the inside surface of the neck of the receptacle 3' in which the tubular skirt 10' is inserted is shaped in such a manner as to enable substance to pass from the inside of the receptacle 3' into the opening 15'.

The pivoting cover 7' differs from the above-described cover 7 mainly by the fact that the tube 25' has a lateral opening running from its end edge to form an opening 35' for passing substance between the lateral opening 15' and the inside 36' of the tube 25'. When the cover 7' is folded down onto the annular body 6', the tube 25' fits in leakproof manner against the inside of the tubular skirt 10'.

Figure 7:
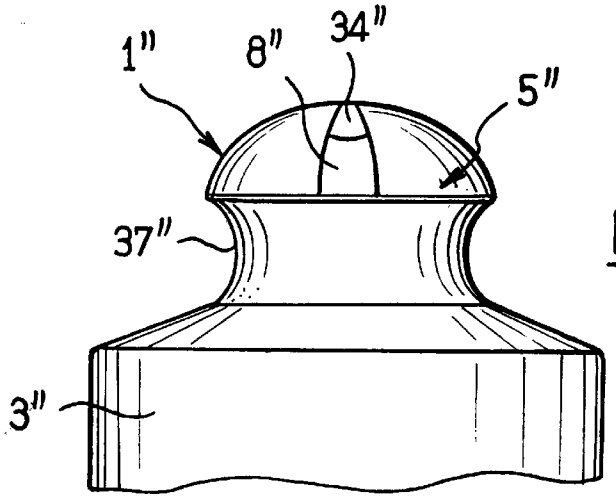
FIG. 7 is a fragmentary elevation view of a receptacle fitted with the dispensing head shown in FIG. 6.
Figure 6:
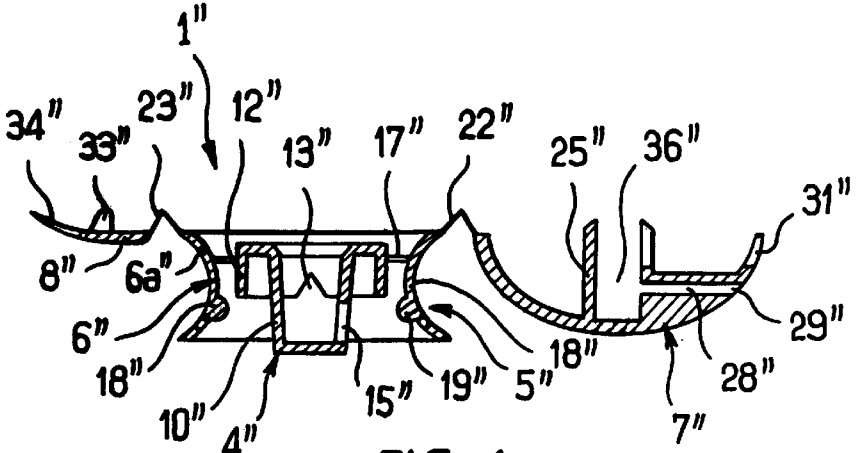
FIG. 6 is a diagrammatic axial section view of a dispensing head constituting a third embodiment of the invention.

FIGS. 6 and 7 show a dispensing head 1" constituting a second variant embodiment of the above-described dispensing head 1.

Identical reference numerals are used in association with the double prime symbol " to reference elements that are identical or functionally analogous to those described above with reference to FIGS. 1 to 3.

The dispensing head 1" differs from the dispensing head 1' mainly in the shape of the annular body 6". This body has an outwardly concave wall **6*a*" which, after the dispensing head 1" has been assembled on the receptacle 3", forms an annular groove 37", as shown in FIG. 7. The endpiece 4", the pivoting cover 7", and the pivoting flap 8" are identical to those described above with reference to FIG. 4**.

Figure 8:
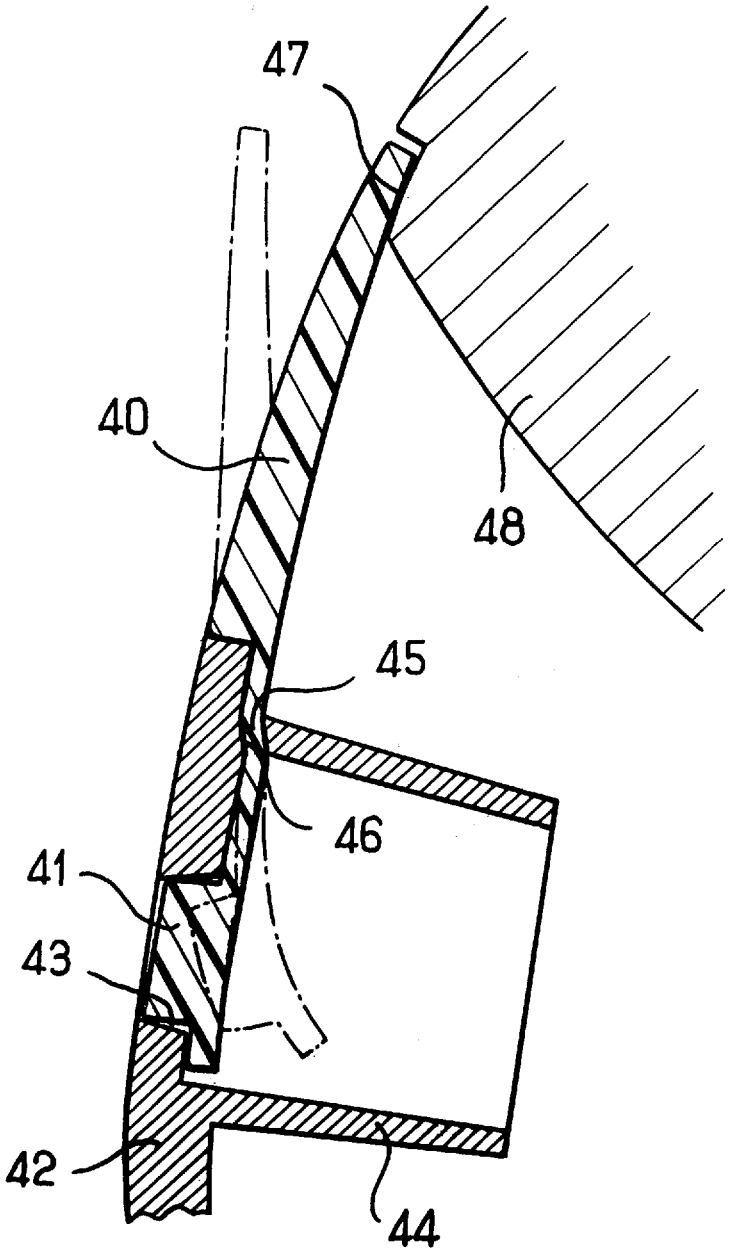
FIG. 8 is a fragmentary section view of a dispensing head constituting a fourth embodiment of the invention.

FIG. 8 shows an embodiment in which two shutters 40 and 41 are provided, one to open while substance is being dispensed and the other to open after dispensing to allow air to be admitted into the receptacle.

In the example described, the shutters 40 and 41 are made as a single piece by molding elastomer plastics material over a flap 42 that is shown in part only, and that is connected by a hinge-forming bridge of material to the remainder of the dispensing head like the flaps 8, 8', and 8" as described above. The overmolding operation is facilitated insofar as the portion carrying the shutters, i.e. the flap 42, extends away from the remainder of the dispensing head during manufacture thereof, being connected thereto by the bridge of material 23. It is thus more easily accessible for the operations involved in overmolding the plastics material.

The flap 42 has an opening 43 associated with the shutter 41. This valve is shaped, when at rest, to engage in the opening 43 and to bear against the inside surface of the flap 42 around the opening 43.

On its inside face, the flap 42 has a tubular wall 44 into which the opening 43 opens out. The blade of elastomer material from which the shutters 40 and 41 are made is fixed to the flap by a portion 45 uniting the two shutters. This portion 45 passes through a hole 46 formed at the base of the tubular wall 44. At rest, the shutter 40 rests against a seat 47 of a cover 48 like the shutters 34, 34', and 34" as described above.

The use of a shutter for admitting air serves to prevent suction being generated inside the receptacle after substance has been dispensed, and thus serves to prevent the walls of the receptacle from collapsing. Also, since air admission takes place by means of the shutter 41, it is possible to shape the shutter 40 in such a manner as to enable it to press in completely leakproof manner against its seat 47, thereby ensuring that no substance leaks out when the device is used with the dispensing head at the bottom.

Figure 9:
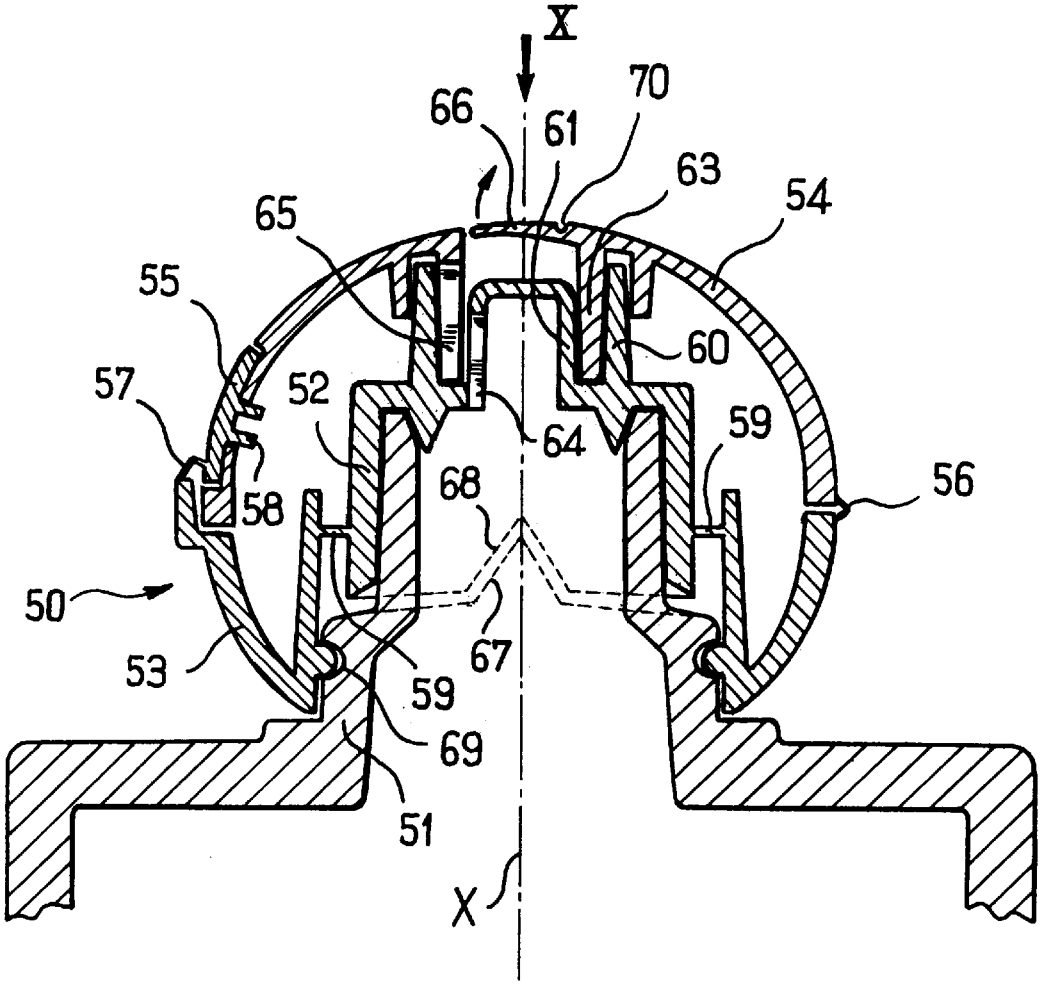
FIG. 9 is a diagrammatic axial section view of a dispensing head constituting a fifth embodiment of the invention.

FIG. 9 shows a dispensing head 50 constituting a fifth embodiment of the invention fitted to the neck 51 of a receptacle.

The dispensing head 50 has an endpiece 52 for fixing in the neck 51 and a capsule integrally formed with the endpiece 52 and constituted by an annular body 53, a pivoting cover 54, and a closure flap 55 in combination. The cover 54 and the flap 55 are connected by respective film hinges 56 and 57 to the annular body 53. The flap 55 has a stud 58 for engaging in a corresponding opening in the cover 54 for the purpose of holding it in place, as shown in FIG. 9.

The annular body 53 is connected by breakable bridges of material 59 to the endpiece 52.

After the bridges 59 had been broken, the capsule can rotate about the axis X of the endpiece.

On top, the endpiece 52 carries two concentric cylindrical skirts 60 and 61 that leave an annular groove between them in which a cylindrical skirt 63 integral with the cover 54 is received. The inner skirt 61 is closed at its top and it has an axially extending slot 64 passing through its side wall.

The skirt 63 also has an axially extending slot 65 to enable the substance contained in the receptacle to escape when the slot 65 is brought into register with the slot 64.

A shutter 66 is placed at the top end of the skirt 63 to prevent dust or sand from penetrating into the receptacle, to reduce the risk of substance leaking out in the event of the receptacle falling over, for example, and also to prevent the substance present on the inside walls of the neck 51 or contained inside the skirt 63 or the slots 64 and 65 from drying out.

By rotating the capsule about the axis X, it is possible to bring the slots into register with each other for dispensing the substance, or on the contrary to move them far enough apart to cut off communication between the shutter 66 and the inside of the receptacle.

While rotating the capsule, which takes place after the bridges 59 have been broken, the endpiece 52 is prevented from rotating on the neck 51, e.g. by mutual engagement of an outside projection 67 on the neck 51 and an opening 68 of complementary shape in the endpiece.

The annular body 53 of the capsule is held axially on the neck by snap-fastening in a groove 69 thereof.

Figure 10:
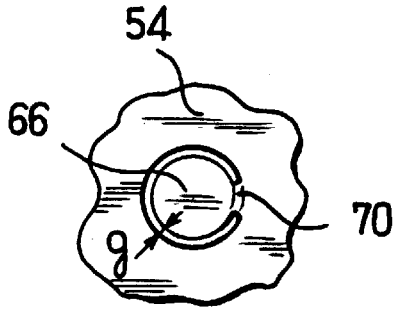
FIG. 10 is a fragmentary plan view seen looking along arrow X in FIG. 9.

The shutter 66 is integrally molded with the cover 54. It is connected to the remainder of the cover by a bridge of material 70 enabling it to be lifted under drive from the substance during dispensing. In plan view, as shown in FIG. 10, the shutter is generally Ω-shaped and its free edge leaves a gap g lying in the range 0.1 mm to 0.2 mm relative to the adjacent edge of the cover. This gap makes air intake possible.

In a variant embodiment (not shown), the shutter 66 is made of the same material as the cover but in a different color, by molding with dual-injection of material. Dual-injection can also be used to make it out of a material that is more flexible than the material from which the remainder of the cover is molded. Finally, the shutter may be made separately and may subsequently be applied and fixed to the cover by any known means.

Finally, the invention makes it possible to make dispensing heads that are undercut in shape and provides greater freedom in selecting the general appearance of the packaging.

The invention makes manufacture of the dispensing head easier, particularly because it enables the shutter(s) to be made without too much difficulty.

The invention also serves to reduce access to the inside of the capsule by foreign bodies such as sand.

The bridges of material 17, 17', 17", or 59 connecting the endpiece to the capsule and suitable for holding the capsule in a position where it isolates the dispensing channel from the inside of the receptacle make it possible, during storage and prior to first use, to prevent the shutter of elastomer material from coming into contact with the substance and to prevent the material of the shutter from swelling.

Advantageously, the invention makes it possible to make undercut shapes for the dispensing head while using a minimum amount of material, since the shell 24 of the capsule can be of small thickness.

FIGS. 1 to 10 correspond to embodiments having an endpiece that is to be fixed in the opening of a receptacle.

It would not go beyond the ambit of the invention to fix the endpiece on a pump or a valve fitted to a receptacle, in which case the dispensing head can also serve as a push-button.

Air may naturally be admitted by the substance-dispensing orifice being closed in a manner that is not completely leakproof while it is not dispensing substance, or while air intake is taking place, or by means of an air admission shutter that is not secured to the shutter which opens under drive from pressure in the substance to be dispensed.

It is also possible to modify the co-operating portions of the endpiece and of the capsule that enable the dispensing head to be opened and closed.

I claim:

1. A device for packaging and dispensing a substance in liquid, gel, or paste form, the device being of the type comprising a receptacle for containing said substance and a dispensing head provided with an orifice for dispensing the substance and with a shutter that is suitable for closing said orifice when the substance is not being dispensed, and suitable for opening under the effect of pressure in the substance upstream, wherein the dispensing head includes at least two portions which are made as a single piece by being molded with a third portion and each of which is connected thereto by a respective hinge-forming bridge of material, one of the two portions connected to the third portion also carrying said shutter.

2. A device according to claim 1, wherein said shutter is molded over the portion carrying it.

3. A device according to claim 1, wherein the dispensing head includes an air admission shutter.

4. A device according to claim 3, wherein the shutter which opens to dispense the substance, and the air admission shutter are made as a single piece by molding elastomer material over one of the two portions each of which is connected to said third portion via a respective hinge-forming bridge of material.

5. A deice according to claim 1, wherein said shutter is integrally molded with the portion that carries it.

6. A device according to claim 5, wherein said shutter is generally Ω-shaped, and wherein its free edge leaves a gap lying in the range 0.1 mm to 0.2 mm relative to the facing edge.

7. A device according to claim 1, wherein the dispensing head includes an endpiece for fixing in an opening of a receptacle or on a pump or a valve fitted to the receptacle, and wherein said portions, each connected to the third portion via a respective hinge-forming bridge of material, constitute a moving capsule provided with said dispensing orifice and mounted with the ability to move relative to the endpiece between an open position in which communication is established between the dispensing orifice and the inside of the receptacle, and a closed position in which the capsule co-operates with the endpiece to isolate said dispensing orifice from the inside of the receptacle.

8. A device according to claim 7, wherein the endpiece is made as a single piece by being molded together with said third portion and being connected thereto by breakable bridges of material.

9. A device according to claim 8, wherein said bridges of breakable material are for breaking on first use of the device and constitute proof that the device has not been tampered with.

10. A device according to claim 8, wherein said bridges of breakable material are broken when the capsule is mounted on the receptacle.

11. A device according to claim 7, wherein said third portion is annular in shape.

12. A device according to claim 1, wherein one of the two portions connected via respective hinge-forming bridges of material to said third portion constitutes a closure flap suitable for holding the second portion on the third portion by co-operation between complementary shapes.

13. A device according to claim 12, wherein the shutter is secured to the portion constituting said closure flap.

14. A device according to claim 12, wherein the shutter is secured to the portion retained on the third portion by said closure flap.

* * * * *